US006109280A

United States Patent [19]

Custer

[11] Patent Number: 6,109,280

[45] Date of Patent: Aug. 29, 2000

[54] PLAYYARD CABANA

[75] Inventor: Marty Custer, Doylestown, Pa.

[73] Assignee: Evenflo Company, Inc., Vandalia, Ohio

[21] Appl. No.: 09/177,180

[22] Filed: Oct. 22, 1998

[51] Int. Cl.[7] ..... E04H 15/04; A47C 29/00

[52] U.S. Cl. ..... 135/116; 135/96; 135/90; 135/124; 135/137; 5/97; 5/414; 5/113; 5/98.1

[58] Field of Search ..... 135/121, 124, 135/125, 90, 115–117, 136–137, 906; 5/93.1, 97, 98.1, 113, 121; D6/331

[56] References Cited

U.S. PATENT DOCUMENTS

| | | | |
|---|---|---|---|
| D. 366,978 | 2/1996 | Mariol | D6/491 |
| D. 383,625 | 9/1997 | Dillner | D6/491 |
| 4,192,333 | 3/1980 | Sato | 135/124 |
| 4,493,120 | 1/1985 | Watts | 5/99.1 |
| 4,590,956 | 5/1986 | Griesenbeck | 135/116 |
| 4,766,918 | 8/1988 | Odekirk | 135/96 |
| 4,790,340 | 12/1988 | Mahoney | 135/90 |
| 4,825,484 | 5/1989 | Riegel | 5/97 |
| 4,837,875 | 6/1989 | Shamie et al. | 5/99.1 |
| 4,852,598 | 8/1989 | Griesenbeck | 135/102 |
| 4,862,534 | 9/1989 | Gomez-Marcial | 5/97 |
| 4,945,584 | 8/1990 | LaMantia | 5/97 |
| 5,002,083 | 3/1991 | Kim | 135/98 |
| 5,311,813 | 5/1994 | Fairbanks et al. | 99/645 |
| 5,517,707 | 5/1996 | LaMantia | 5/97 |
| 5,666,986 | 9/1997 | Fox | 135/135 |
| 5,862,548 | 1/1999 | Gerhart | 135/117 X |
| 5,913,322 | 6/1999 | Gallant et al. | 135/124 X |

*Primary Examiner*—Carl D. Friedman
*Assistant Examiner*—Winnie Yip
*Attorney, Agent, or Firm*—Thompson Hine & Flory LLP

[57] ABSTRACT

A cabana system adapted for use in a stand-alone mode is disclosed. The system includes a separable floor for use as a cover for a playyard of the type having vertically extending reception apertures in the upper corners thereof. The system is comprised of a frame fabricated of two flexible rods. Each flexible rod is hollow with free ends adapted to be received within apertures of a playyard. The rods are positioned in side-by-side relationship to thereby form a generally cylindrical central extent. The rod placement further forms spaced semi-circular planar surfaces on opposite sides thereof at the ends of the central sections. A fabric cover covers the tubes with a screen door in a semi-circular configuration in one planar face thereof with a fastener for coupling and uncoupling the screened panel. A fabric floor is formed as an extension of one planar face remote from the screen door and is adapted to depend downwardly over one side of the playyard when deployed thereon. The floor has a fastener to couple the floor to the lower periphery of the frame when used in a stand-alone mode independent of the playyard.

8 Claims, 3 Drawing Sheets

PLAYYARD CABANA

BACKGROUND OF THE INVENTION

1. Field of the Invention

The present invention relates to a new and improved cabana system adapted for use in a stand-alone mode or as a cover for a playyard and, more particularly, pertains to utilizing a cabana for the safety and comfort of a child either by itself or as a covering for a playyard.

2. Description of the Prior Art

The use of child care products of known designs and configurations is known in the prior art. More specifically, child care products of known designs and configurations heretofore devised and utilized for the purpose of adding to the safety and comfort of infants through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of child care products of known designs and configurations. By way of example, U.S. Pat. No. 4,590,956 to Griesenbeck, issued May 27, 1986 and unassigned on its face, discloses a bed tent. U.S. Pat. No. 4,766,918 to Odekirk, issued Aug. 30, 1988 and assigned on its face to Aspen Enterprises, Inc., discloses a convertible, inflatable shelter apparatus. U.S. Pat. No. 4,790,340 to Mahoney, issued Dec. 13, 1988 and unassigned on its face, relates to a canopy for a child's playpen. U.S. Pat. No. 4,825,484 to Riegel, issued May 2, 1989 and unassigned on its face, discloses a crib with safety-top, U.S. Pat. No. 4,852,598 to Griesenbeck, issued Aug. 1, 1989 and unassigned on its face, relates to a bed tent. U.S Pat. No. 4,945,584 to LaMantia, issued Aug. 7, 1990 and assigned on its face to Tots-In-Mind, Inc., discloses a crib cover. U.S. Pat. No. 5,002,083 to Kim, issued Mar. 26, 1991 and assigned on its face to Baejin Corporation, discloses a tent cover retaining device. U.S. Pat. No. 5,311,813 to Fairbanks, et al., issued May 17, 1994 and unassigned on its face, relates to a cutting surface having a tent-like cover providing closeable access to the cutting board. U.S. Pat. No. 5,517,707 to LaMantia, issued May 21, 1996 and unassigned on its face, relates to a crib cover securing device. U.S. Pat. No. 5,666,986 to Fox, issued Sep. 16, 1997 and assigned on its face to Fox Design International Limited, discloses a tent frame device. U.S. Pat. No. Des. 366,978 to Mariol, issued Feb. 13, 1996 and assigned on its face to Lisco, Inc., discloses a removable playyard canopy. Lastly, U.S. Pat. No. Des. 383,625 to Dillner, issued Sep. 16, 1997 and assigned to Graco, discloses a canopy for a child play area.

In this respect, the cabana system adapted for use in a stand-alone mode or as a cover for a playyard according to the present invention substantially departs from the conventional concepts and designs of the prior art, and in doing so provides an apparatus primarily developed for the purpose of utilizing a cabana for the safety and comfort of a child either by itself or as a covering for a playyard.

Therefore, it can be appreciated that there exists a continuing need for a new and improved cabana system adapted for use in a stand-alone mode or as a cover for a playyard which can be used for utilizing a cabana for the safety and comfort of a child either by itself or as a covering for a playyard. In this regard, the present invention substantially fulfills this need.

SUMMARY OF THE INVENTION

In view of the foregoing disadvantages inherent in the known types of child care products of known designs and configurations now present in the prior art, the present invention provides a new and improved cabana system adapted for use in a stand-alone mode or as a cover for a playyard. As such, the general purpose of the present invention, which will be described subsequently in greater detail, is to provide a new and improved cabana system adapted for use in a stand-alone mode or as a cover for a playyard and methods which have all the advantages of the prior art and none of the disadvantages.

To attain this, the present invention essentially comprises a new and improved cabana system. The system is adapted for use in a stand-alone mode. The system further includes a separable floor for use as a cover for a playyard of the type having vertically extending reception apertures in the upper corners thereof.

A first major component o the system is a frame fabricated of two flexible rods. Each flexible rod is hollow with free ends adapted to be received within apertures of the playyard. The rods are positioned in side-by-side relationship closer at their central points than n at their ends to thereby form a generally cylindrical central extent narrower at the midpoint than at the ends and with spaced semi-circular planar surfaces on opposite sides thereof. Each of the rods is formed of a central section constituting about a third of the length with couplable end sections at the ends of the central sections.

The second major component of the system 10 is a fabric cover covering the tubes and attached at their central extents. The fabric cover has triangular vents on the cylindrical central section adjacent to the top. A screen door in a semi-circular configuration in one planar face thereof is provided. The screen door has a sliding fastener for coupling and uncoupling the screened panel.

The third major component of the system 10 is a fabric floor formed as an extension of one planar face remote from the screen door. The fabric floor is adapted to depend downwardly over one side of the playyard when deployed thereon. The floor has a sliding fastener to couple the floor to the lower periphery of the frame when used in a stand-alone mode independent of the playyard. Further, the floor has pockets for receiving the free ends of the tubes.

Lastly provided as a major component of the system 10 is a floor panel formed of four coupled rectangular sections positionable either on the floor of the playyard when the cabana is used therewith or positionable on the floor of the cabana when standing independent of the playyard.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cabana system adapted for use in a stand-alone mode or as a cover for a playyard which has all the advantages of the prior art child care products of known designs and configurations and none of the disadvantages.

It is another object of the present invention to provide a new and improved cabana system adapted for use in a stand-alone mode or as a cover for a playyard which may be easily and efficiently manufactured and marketed.

It is a further object of the present invention to provide a new and improved cabana system adapted for use in a stand-alone mode or as a cover for a playyard which is of a durable and reliable construction.

An even further object of the present invention is to provide a new and improved cabana system adapted for use in a stand-alone mode or as a cover for a playyard which is susceptible of a low cost of manufacture with regard to both materials and labor, and which accordingly is then susceptible of low prices of sale to the consuming public, thereby making such a cabana system adapted for use in a stand-alone mode or as a cover for a playyard economically available to the buying public.

Even still another object of the present invention is to utilize a cabana for the safety and comfort of a child either by itself or as a covering for a playyard.

Lastly, it is an object of the present invention to provide a cabana system adapted for use in a stand-alone mode. The system includes a separable floor for use as a cover for a playyard of the type having vertically extending reception apertures in the upper corners thereof. The system is comprised of a frame fabricated of two flexible rods. Each flexible rod is hollow with free ends adapted to be received within apertures of a playyard. The rods are positioned in side-by-side relationship to thereby form a generally cylindrical central extent. The rod placement further forms spaced semi-circular planar surfaces on opposite sides thereof at the ends of the central sections. A fabric cover covers the tubes with a screen door in a semi-circular configuration in one planar face thereof with a fastener for coupling and uncoupling the screened panel. A fabric floor is formed as an extension of one planar face remote from the screen door and is adapted to depend downwardly over one side of the playyard when deployed thereon. The floor has a fastener to couple the floor to the lower periphery of the frame when used in a stand-alone mode independent of the playyard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
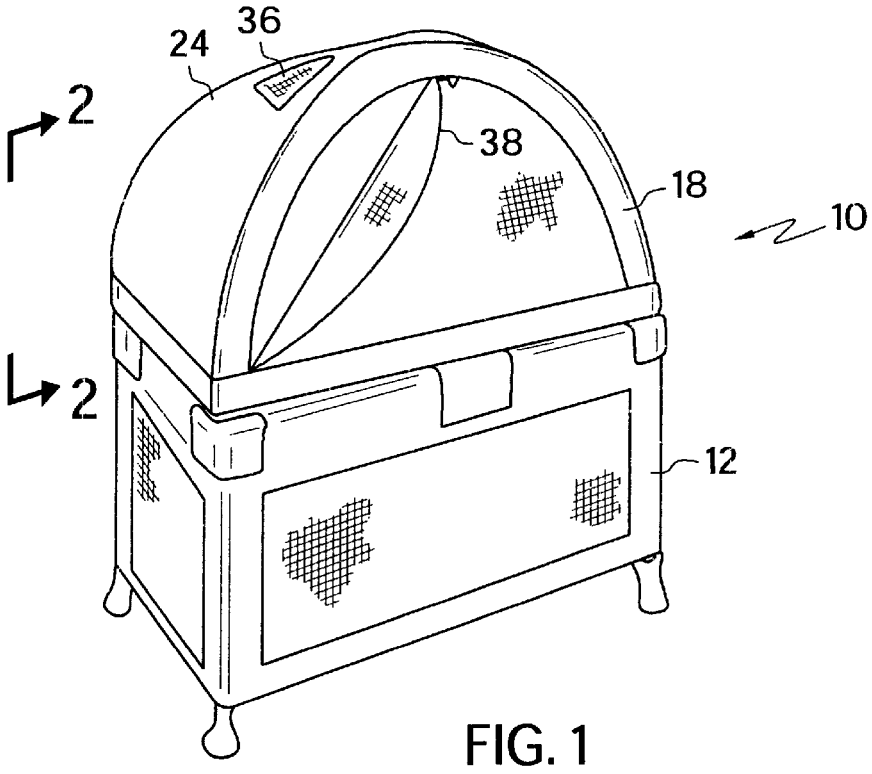
FIG. 1 is a perspective illustration of the new and improved cabana system constructed in accordance with the principles of the present invention.
Figure 2:
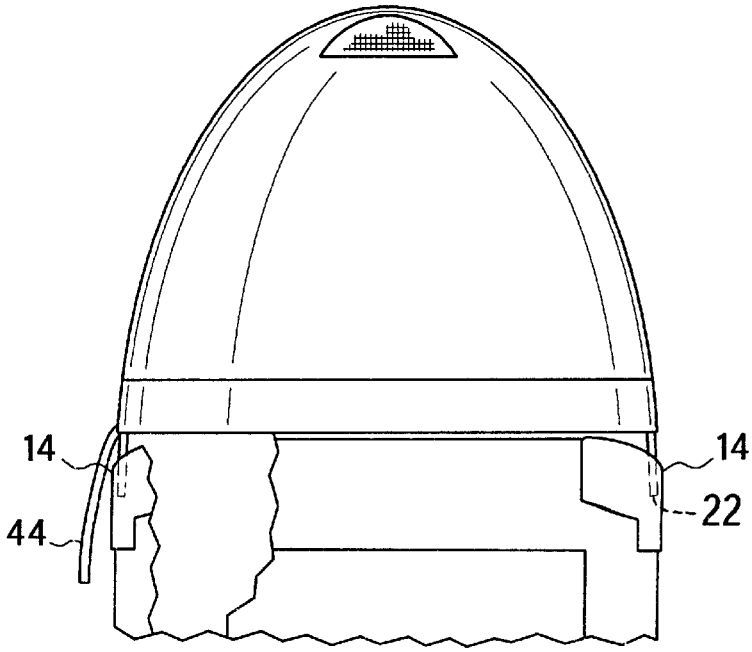
FIG. 2 is a side elevational view of the system shown in FIG. 1.
Figure 3:
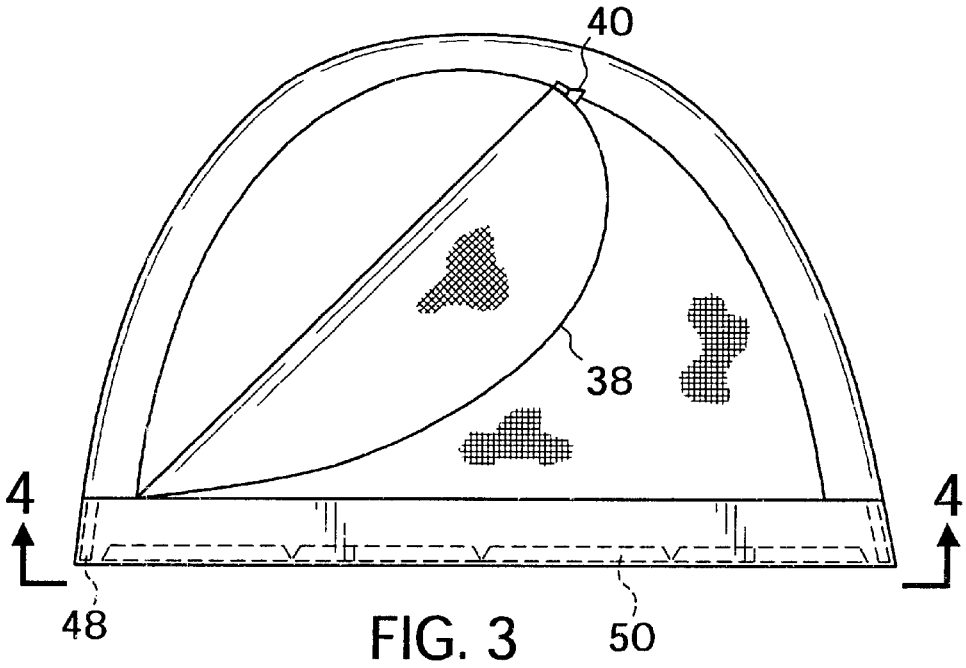
FIG. 3 is a front elevational view of the cabana shown in FIGS. 1 and 2 but standing independent of the playyard.
Figure 4:
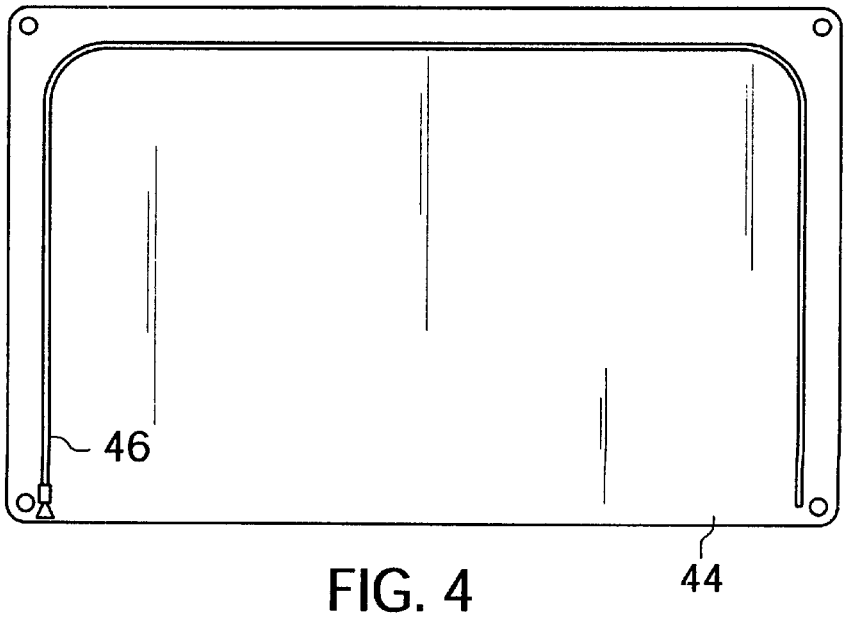
FIG. 4 is a bottom elevational view taken along line 4—4 of FIG. 3.
Figure 5:
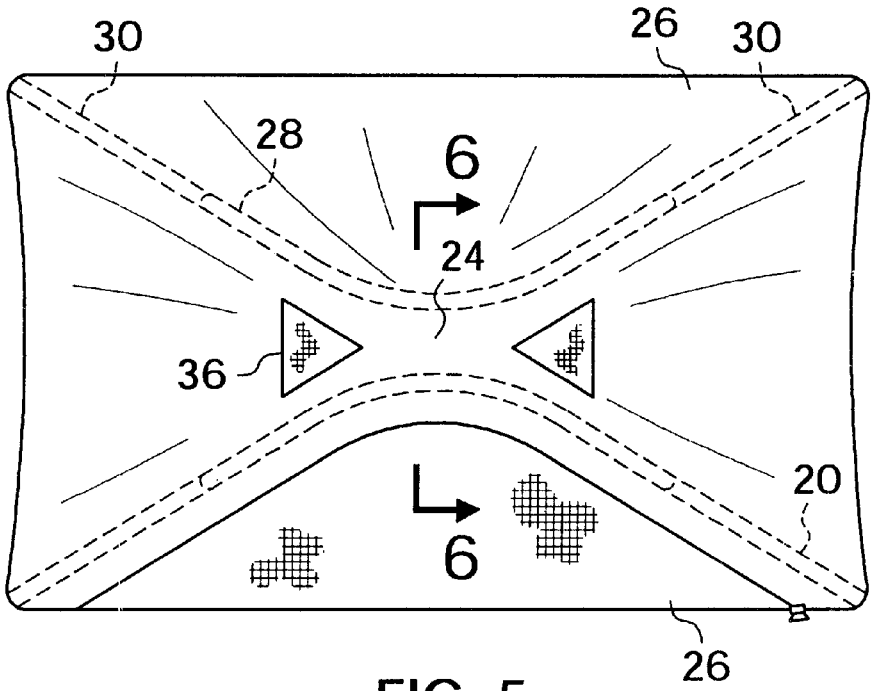
FIG. 5 is a top elevational view of the cabana whether in either mode.
Figure 6:
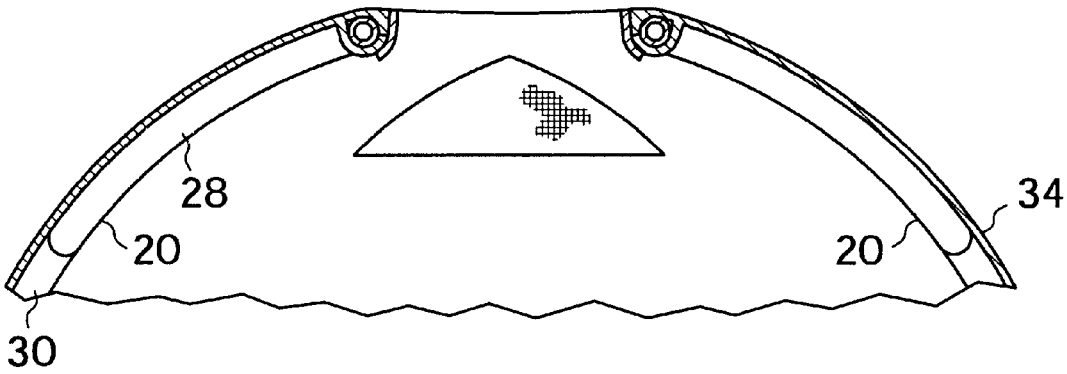
FIG. 6 is a cross-sectional view taken along line 6—6 of FIG. 5.

With reference now to the drawings, and in particular to FIGS. 1 through 6 thereof, the preferred embodiment of the new and improved cabana system adapted for use in a stand-alone mode or as a cover for a playyard embodying the principles and concepts of the present invention and generally designated by the reference numeral 10 will be described.

The present invention, the new and improved cabana system adapted for use in a stand-alone mode or as a cover for a playyard is a system 10 comprised of a plurality of components. Such components, in their broadest context, include a frame, a fabric cover, a fabric floor, and a floor panel. Each of the individual components is specifically configured and correlated one with respect to the other so as to attain the desired objectives.

The present invention, a new and improved cabana system 10, is adapted for use in a stand-alone mode. The cabana system includes a separable floor for use as a cover for a playyard 12 of the type having vertically extending reception apertures 14 in the upper corners thereof.

As a major component of the system 10, a frame 18 is fabricated of two flexible rods 20. Each flexible rod is hollow. Each rod further employs free ends 22. The free ends are adapted to be received within apertures 14 of the playyard. In such configuration, the rods are positioned in side-by-side relationship closer at their central points than at their ends. This relationship thereby forms a generally cylindrical central extent 24 narrower at the midpoint than at the ends and with spaced semi-circular planar surfaces 26 on opposite sides thereof. Each of the rods is formed of a central section 28 constituting about a third of the length with couplable end sections 30 at the ends of the central sections.

Next provided as a component of the system 10 is a fabric cover 34. The fabric cover covers the tubes and is attached at their central extents. Further, the fabric cover has triangular vents 36 on the cylindrical central section adjacent to the top. A screen door 38 is formed in a semi-circular configuration in one planar face thereof. The screen door is provided with a sliding fastener 40 for coupling and uncoupling the screened panel.

A fabric floor 44 is provided as the next component of the system 10. The floor is formed as an extension of one planar face remote from the screen door. The floor is adapted to depend downwardly over one side of the playyard when deployed thereon. Further, the floor has a sliding fastener 46 which couples the floor to the lower periphery of the frame when used in a stand-alone mode independent of the playyard. Lastly, the floor has pockets 48 for receiving the free ends of the tubes.

The last major component of the system 10 is a floor panel 50. The floor panel is formed of four coupled rectangular sections. The four rectangular sections are positionable either on the floor of the playyard when the cabana is used therewith or positionable on the floor of the cabana when standing independent of the playyard.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cabana system adapted for use in a stand-alone mode and with a separable floor for use as a cover for a playyard of the type having vertically extending reception apertures in the upper corners thereof comprising, in combination:

a frame fabricated of two flexible rods, each flexible rod being hollow with free ends adapted to be received within apertures of the playyard, the rods being positioned in side-by-side relationship closer at their central points than at their ends to thereby form a generally cylindrical central extent narrower at the midpoint than at the ends and with spaced semi-circular planar surfaces on opposite sides thereof, each of the rods being formed of a central section constituting about a third of the length with couplable end sections at the ends of the central sections;

a fabric cover covering the rods and attached at their central extents, the fabric cover having triangular vents on the cylindrical central section adjacent to the top with a screen door in a semi-circular configuration in one planar face thereof with a sliding fastener for coupling and uncoupling the screen door;

a fabric floor formed as an extension of one planar face of the fabric cover remote from the screen door and adapted to depend downwardly over one side of the playyard when deployed thereon, the floor having a sliding fastener to couple the floor to the lower periphery of the fabric cover when used in a stand-alone mode independent of the playyard, the floor having pockets for receiving the free ends of the rods; and a floor panel formed of four coupled rectangular sections positionable either on the floor of the playyard when the frame and fabric cover are positioned thereon or positionable on the floor of the fabric over when the frame and fabric cover stand independent of the playyard.

2. The combination cabana as set forth in claim 1 wherein each of the rods is formed of a central section constituting about a third of the length with couplable end sections at the ends of the central sections.

3. The combination cabana as set forth in claim 2 wherein each rod is attached at its central section to the fabric cover.

4. The combination cabana as set forth in claim 1 wherein the floor has pockets for receiving the free ends of the rods.

5. The combination cabana as set forth in claim 1 and further including a floor panel formed of four coupled rectangular sections positionable either on the floor of the playyard when the frame and fabric cover are positioned thereon or positionable on the floor of the fabric cover when the frame and fabric cover stand independent of the playyard.

6. A combination cabana for a playyard and stand-alone play structure, comprising:

a frame and fabric cover assembly including two flexible rods, each flexible rod including free ends adapted to be received within apertures of a playyard, the rods being spaced apart and positioned in side-by-side relationship, the fabric cover supported by the flexible rods so as to provide a generally cylindrically contoured central extent, with spaced semi-circular planar surfaces on opposite sides thereof, the fabric cover including a door panel segment in one planar face thereof with a fastener for coupling and uncoupling the door panel segment, the fabric cover including a floor panel segment formed as an extension of one planar face thereof remote from the door panel segment, the floor panel segment having a fastener to releasably couple the floor panel segment in a generally horizontal position to act as an integral floor for the frame and fabric cover assembly when used as a stand-alone play structure and for permitting the floor panel segment to depend downwardly over one side of a playyard when deployed thereon.

7. A combination cabana for a playyard and stand-alone play structure, comprising:

a frame and fabric cover assembly including two spaced apart flexible support rods, the fabric cover being supported by the flexible rods so as to provide spaced planar surfaces on opposite sides thereof, the fabric cover including a door panel segment in one planar surface thereof with a fastener for coupling and uncoupling the door panel segment, the fabric cover including a floor panel segment permanently attached thereto at one side thereof, the floor panel segment having a fastener to releasably couple the floor panel segment in a generally horizontal position to act as an integral floor for the frame and fabric cover assembly when used as a stand-alone play structure and for permitting the floor panel segment to depend downwardly over one side of a playyard when deployed thereon.

8. The combination cabana of claim 7 wherein the one side at which the floor panel segment is permanently attached is remote from the door panel segment, and wherein the fastener of the floor panel segment comprises a sliding fastener for releasably coupling substantially the entire periphery of the floor panel segment.

* * * * *